US005158664A

United States Patent [19]

Colgan et al.

[11] Patent Number: 5,158,664

[45] Date of Patent: Oct. 27, 1992

[54] INNERFRAME FOR PACKING CIGARETTES OF VARIABLE DIAMETER IN STANDARD WIDTH PACK

[75] Inventors: John R. Colgan, Richmond, Va.; Howard H. Fishburne, Charlotte, N.C.; Xuan M. Pham, Richmond, Va.

[73] Assignee: Philip Morris Incorporated, New York, N.Y.

[21] Appl. No.: 802,339

[22] Filed: Dec. 4, 1991

[51] Int. Cl.[5] ..... A24F 15/00; B65D 85/10

[52] U.S. Cl. ..... 206/242; 206/268; 206/273

[58] Field of Search ..... 206/242, 268, 271, 273

[56] References Cited

U.S. PATENT DOCUMENTS 4,303,154 12/1981 Hicks ..... 206/242
4,667,688 5/1987 Roig et al. ..... 206/242
4,771,882 9/1988 Lowe et al. ..... 206/271 X
4,850,482 7/1989 Campbell ..... 206/273
4,948,038 8/1990 Moeller ..... 206/271 X

*Primary Examiner*—William I. Price
*Attorney, Agent, or Firm*—Brenda J. Panichi

[57] ABSTRACT

An interframe for insertion into a cigarette box is provided. The innerframe allows a bundle of smaller than standard size cigarettes to be securely retained in a standard size cigarette box, which is larger than necessary to hold the smaller than standard size cigarettes. The innerframe creates space in the box so that the cigarettes are securely retained. The innerframe has a front panel, outer side panels, inner side panels, top panels and windows situated between the front panel and each of the outer side panels.

26 Claims, 2 Drawing Sheets

FIG. 2
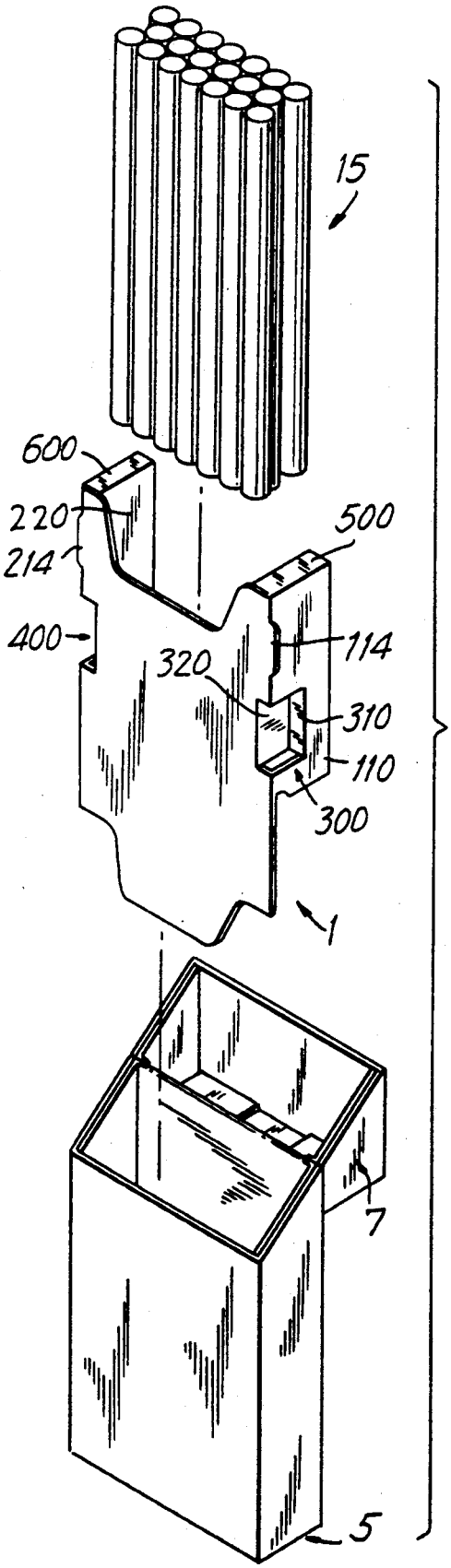
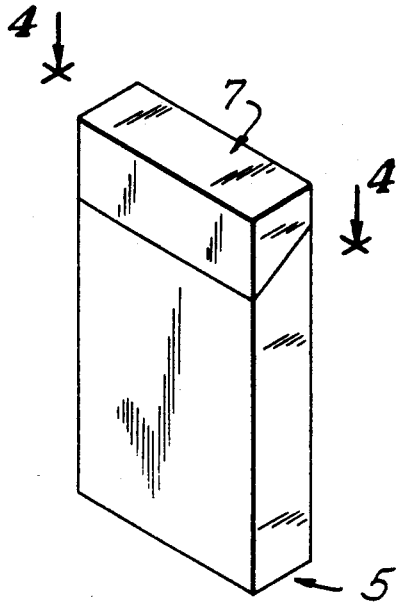
FIG. 3
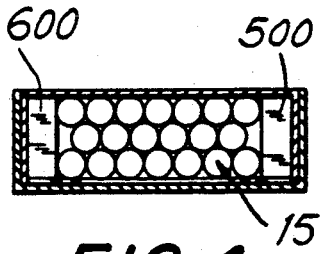
FIG. 4

INNERFRAME FOR PACKING CIGARETTES OF VARIABLE DIAMETER IN STANDARD WIDTH PACK

BACKGROUND OF THE INVENTION

This invention relates to cigarette boxes, and particularly to an innerframe inserted into a cigarette box for securely retaining a bundle of cigarettes of smaller than standard size circumference in a standard size cigarette box.

Cigarettes are usually sold in packs containing twenty cigarettes. Typically, the cigarettes are bundled into three rows, two rows containing seven cigarettes and one row containing six cigarettes. The bundle is then wrapped in a sheet of foil or other material. A standard size cigarette has a circumference of approximately 25 millimeters. Accordingly, cigarette packs are generally made to a standard size in order to accommodate a bundle of twenty cigarettes as described.

Cigarettes having circumferences smaller than 25 millimeters have recently increased in popularity. This type of cigarette typically has a circumference of approximately 19.5 millimeters. Because these smaller than standard size cigarettes occupy less space than the same number of standard size cigarettes, packaging of smaller cigarettes must accommodate the decrease in occupied space.

A bundle of twenty smaller than standard size cigarettes could be packaged in a very small cigarette box designed to hold exactly that number of cigarettes in a selected configuration. However, for tax stamping reasons, package manufacturing and aesthetic reasons, it may be desirable to package a bundle of smaller than standard size cigarettes in a standard size box, which is larger than necessary to hold the bundle of cigarettes. The problems associated with the packaging of smaller than standard size cigarettes and the desirability of packaging this type of cigarette in a standard size pack were set forth and more fully discussed in U.S. Pat. No. 4,850,482, the disclosure of which is incorporated herein by reference.

Accordingly, a means is required for securely retaining a bundle of smaller than standard size cigarettes in a standard size pack.

SUMMARY OF THE INVENTION

It is an object of this invention to provide an innerframe for a cigarette box larger than is necessary for securely retaining a bundle of smaller than standard size cigarettes so as to allow a bundle of such cigarettes to be packaged in boxes that can be manufactured on existing machinery.

It is also an object of this invention to provide an innerframe for a cigarette box larger than is necessary for securely retaining a bundle of smaller than standard size cigarettes so as to allow a bundle of such cigarettes to be packaged in a box that is believed to be more aesthetically pleasing to smokers.

It is also an object of this invention to provide an innerframe for a cigarette box larger than is necessary for securely retaining a bundle of smaller than standard size cigarettes so as to allow tax stamps to be applied using conventional tax stamp machinery on cigarette boxes holding bundles of smaller than standard size cigarettes.

In accordance with the invention, an innerframe for insertion into a cigarette box is provided. The innerframe is folded from a blank and is inserted into a cigarette box during the packaging process. The innerframe creates space in the cigarette box so that the bundle of smaller than standard size cigarettes is securely retained in the box. The innerframe has a front panel with a cutout portion through which cigarettes may be withdrawn, outer side panels which are fitted against the interior surfaces of the box sides, top panels which form an even surface with the ends of the cigarettes visible as the box is opened, inner side panels which are parallel to the outer side panels and against which the outermost cigarettes in the bundle rest, and rectangularly shaped windows which extend inwardly and between the outer and inner side panels. The inner side panels are provided with locking tabs which engage the surface of the window panels to continue the surface of the inner side panels.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout, and in which:

FIG. 2 is a perspective view of a bundle of cigarettes, an innerframe erected from the blank shown in FIG. 1 and a cigarette box into which the bundle and innerframe are inserted;

FIG. 3 is a perspective view of a cigarette box containing an erected innerframe and cigarette bundle;

FIG. 4 is an end view of a cigarette bundle within a box and erected innerframe taken along line 4—4 of FIG. 3.

DETAILED DESCRIPTION OF THE PREFERRED EMBODIMENT

Figure 1:
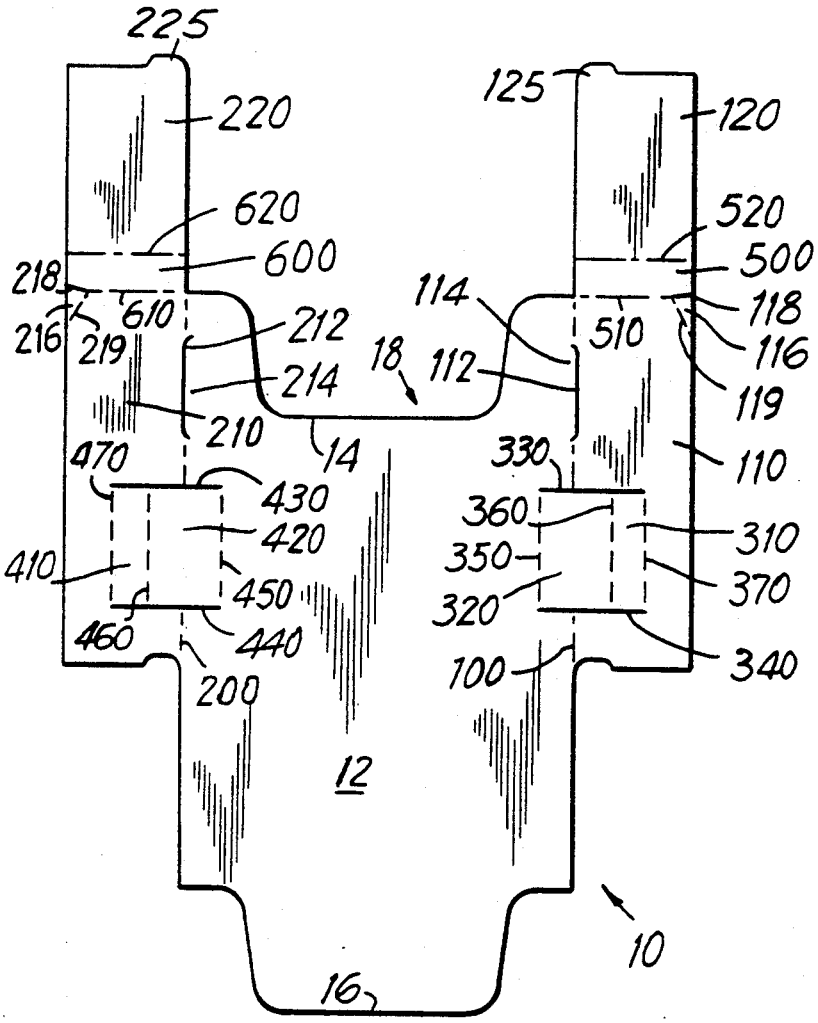
FIG. 1 is a plan view of a preferred embodiment of a blank according to this invention in its unerected state.

A preferred embodiment of the present invention is shown in FIGS. 1-5. The innerframe is erected from blank 10 as shown in FIG. 1. The blank comprises front panel 12, first outer side panel 110, second outer side panel 210, first top panel 500, second top panel 600, first side window panel 320, first rear window panel 310, second side window panel 420, second rear window panel 410, first inner side panel 120 and second inner side panel 220. Front panel 12 is defined by first front panel fold line 100, second front panel fold line 200, top front panel margin 14 and bottom front panel margin 16. Front panel 12 is provided with cutout region 18 at top front panel margin 14 that provides an opening through which cigarettes may be withdrawn from the assembled box.

First outer side panel 110 is connected to front panel 12 along first front panel fold line 100. When erected, blank 10 is bent along first front panel fold line 100 such that first outer side panel 110 is approximately perpendicular to front panel 12.

Second outer side panel 210 is connected to front panel 12 along second front panel fold line 200. When erected, blank 10 is bent along second front panel fold line 200 such that second outer side panel 210 is approximately perpendicular to front panel 12.

Figure 5:
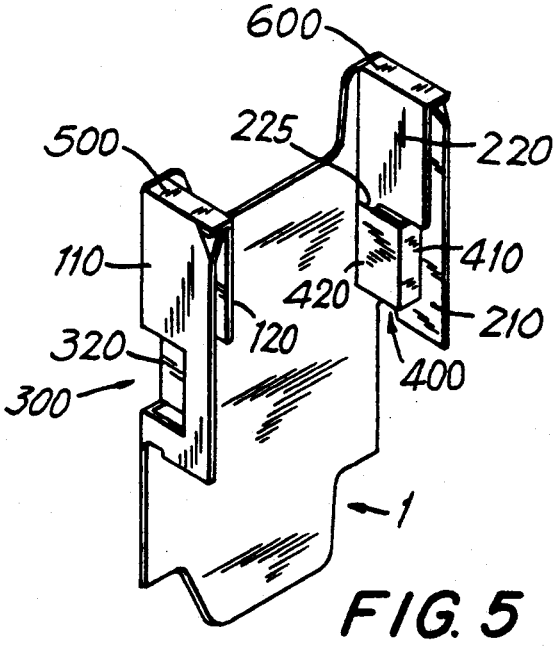
FIG. 5 is a perspective view of the interior surface of an innerframe erected from the blank shown in FIG. 1.

Situated between first outer side panel 110 and front panel 12 and second outer side panel 210 and front panel 12 are first and second windows 300, 400. First window 300 is defined by first upper horizontal window panel cut 330 and first lower horizontal window panel cut 340. First window 300 is comprised of first side window panel 320 and first rear window panel 310. First side window panel 320 is defined by first window panel score line 350 and second window panel score line 360. Second window panel score line 360 also defines one side of first rear window panel 310. As seen in FIGS. 2 and 5, when the innerframe is erected first outer side panel 110 is approximately perpendicular to front panel 12, and first window 300 is formed by first upper and first lower horizontal window panel cuts 330, 340 and first, second and third window panel score lines 350, 360, and 370. It can also be seen from FIGS. 2 and 5 that first side window panel 320 is approximately parallel to first outer side panel 110 and first rear window panel 310 is approximately parallel to innerframe front panel 12.

Similarly, second window 400 is defined by second upper horizontal window panel cut 430 and second lower horizontal window panel cut 440. Second window 400 is comprised of second side window panel 420 and second rear window panel 410. Second side window panel 420 is defined by fourth window panel score line 450 and fifth window panel score line 460. Fifth window panel score line 460 also defines one side of second rear window panel 410. As seen in FIGS. 2 and 5, when the innerframe is erected second outer side panel 210 is approximately perpendicular to front panel 12, and second window 400 is formed by second upper and second lower horizontal window panel cuts 430, 440 and fourth, fifth and sixth window panel score lines 450, 460, and 470. It can also be seen from FIGS. 2 and 5 that second side window panel 420 is approximately parallel to second outer side panel 210 and second rear window panel 410 is approximately parallel to innerframe front panel 12.

As seen in FIG. 1, first upper horizontal window cut 330, first window panel score line 350 and third window panel score line 370 may be "overcut" so as to extend beyond their points of intersection. Overcutting facilitates innerframe erection and adds dimensional stability to the innerframe. Similarly, the intersecting regions between first lower horizontal window cut 340, first window panel score line 350 and third window panel scoreline 370, second upper horizontal window cut 430, fourth window panel score line 450 and sixth window panel score line 470, and second lower horizontal window panel cut 440, fourth window panel score line 450 and sixth window panel score line 470 may also be overcut.

Referring to FIGS. 1 and 4, top panels 500 and 600 can be seen. When cigarette box 5 is opened, top panels 500 and 600 can be seen bordering cigarette bundle 15 as illustrated in FIG. 4. First top panel 500 is located between first outer side panel 110 and first inner side panel 120. Separating first outer side panel 110 and first top panel 500 is first top panel fold line 510. Separating first top panel 500 and first inner side panel 120 is second top panel fold line 520.

Similarly, second top panel 600 is located between second outer side panel 210 and second inner side panel 220. Separating second outer side panel 210 and second top panel 600 is third top panel fold line 610. Separating second top panel 600 and second inner side panel 220 is fourth top panel fold line 620.

As shown in FIG. 2, when the innerframe is erected, first and second inner side panels 120, 220 are approximately parallel to first and second outer side panels 110, 210, with first and second top panels 500, 600 approximately perpendicular to first and second inner side panels 120, 220 as well as to first and second outer side panels 110, 210.

First inner side panel 120 is provided with first locking tab 125. Second side panel 220 is provided with second locking tab 225. When the innerframe is erected, first locking tab 125 is fitted against the surface of first side window panel 320 and second locking tab 225 is fitted against the surface of second side window panel 420. As shown in FIG. 5, inner side panels 120, 220 and side window panels 320, 420 form a continuous surfaces against which the outermost cigarettes in bundle 15 rest.

Cigarette box 5 shown in FIGS. 2 and 3 receives innerframe 1 and bundle 15 as shown in FIG. 2. Erected innerframe 1 is inserted and adhesively attached to cigarette box 5. Innerframe 1 may also be provided with means to retain box lid 7. As illustrated in FIGS. 1 and 2, innerframe 1 is provided with first lid retention cut 112 located near first front panel fold line 100 and second lid retention cut 212 located near second front panel fold line 200. First and second lid retention cuts 112, 212 define first and second lid retention tabs 114, 214 which protrude a small distance beyond front panel 12 and provide frictional engagement with the inside surface of box lid 7.

Innerframe 1 may also be provided with first lid retention ear 116 and second lid retention ear 216, first lid retention ear 116 being located on the outer portion of first outer side panel 110 adjacent first top panel 500 and second lid retention ear 216 being located on the outer portion of second outer side panel 210 adjacent second top panel 600. First and second lid retention ears 116, 216 are small triangularly shaped sections defined by first and second lid retention ear cuts 118, 218 extending a short distance into first and third top panel fold lines 510, 610 and first and second lid retention ear bend lines 119, 219 extending angularly outward from the interior limits of first and second lid retention ear cuts 118, 218 toward the outer limits of first and second outer side panels 110, 210. When cigarette box 5 and innerframe 1 are constructed, first and second lid retention ears 116, 216 are folded slightly downward, leaving a small gap at the back edge of the erected innerframe 1. Thus, when lid 7 of cigarette box 5 is closed, the back panel of box lid 7 is fitted within the gap created by first and second lid retention ears 116, 216, thereby maintaining lid 7 closed.

It will be apparent to those skilled in the art that the invention described herein can be practiced by other than the embodiments described above, which are presented for the purpose of illustration and not of limitation, and the present invention is limited only by the claims which follow.

We claim:

1. A blank for forming an innerframe for insertion into a cigarette box for retaining a bundle of cigarettes in the box, the blank comprising:

a front panel defined by a pair of parallel first and second fold lines and top and bottom panel margins;

a first outer side panel which is substantially rectangular in shape, the first outer side panel connected to the front panel along the first fold line, and further defined by a first top panel fold line;

a second outer side panel which is substantially rectangular in shape, the second outer side panel connected to the front panel along the second fold line, and further defined by a third top panel fold line;

a first top panel connected to the first outer side panel along the first top fold line and further defined by a second top panel fold line;

a second top panel connected to the second outer side panel along the third top panel fold line and further defined by a fourth top panel fold line;

a first window defined by a first, a second and a third window panel score line and a first upper horizontal window panel cut and a first lower horizontal window panel cut and located between the front panel and the first outer side panel, the first window further comprising a first side window panel connected to the front panel along the first window panel score line and further defined by the second window panel score line, a first rear window panel connected to the first outer side panel along the third window panel score line and connected to the first side window panel along the second window panel score line;

a second window defined by a fourth, a fifth and a sixth window panel score line, a second upper horizontal window panel window panel cut and a second lower horizontal window panel cut and located between the front panel and the second outer side panel, the second window further comprising a second side window panel connected to the front panel along the fourth window panel score line and further defined by the fifth window panel score line, a second rear window panel connected to the second outer side panel along the sixth window panel score line and connected to the second side window panel along the fifth window panel score line;

a first inner side panel connected to the first top panel along the second top panel fold line; and a second inner side panel connected to the second top panel along the fourth top panel fold line.

2. The blank of claim 1 wherein the first top panel is provided with a first locking tab engageable with the first side window panel and the second top panel is provided with a second locking tab engageable with the second side window panel.

3. The blank of claim 1 wherein the first, the second, the third, the fourth, the fifth, and the sixth window panel score lines are perforated.

4. The blank of claim 1 wherein the front panel is provided with a first lid retention cut located along the first fold line and above the first window, and a second lid retention cut located along the second fold line and above the second window.

5. The blank of claim 4 wherein the first and the second lid retention cuts are substantially C-shaped.

6. The blank of claim 1 or claim 4 wherein the first outer side panel is provided with a first lid retention ear extending angularly between an outside margin of the first outer side panel and the first top panel fold line and a second lid retention ear extending angularly between an outside margin of the second outer side panel and the third top panel fold line.

7. The blank of claim 1 wherein the first and second fold lines are folded to erect the first outer side panel and the second side panel perpendicular to the front panel, the first top and second top panel fold lines are folded to erect the first top panel and the first inner side panel, the first top panel being perpendicular to both the front panel and the first outer side panel and the first inner side panel parallel to the first outer side panel, the third and fourth top panel fold lines are folded to erect the second top panel and the second inner side panel, the first top panel being perpendicular to both the front panel and the second outer side panel and the second inner side panel being parallel to the second outer side panel.

8. The blank of claim 1 wherein the front panel is further defined by a cutout region at the top margin thereby forming an opening through which cigarettes may be withdrawn.

9. The blank of claim 1 wherein the blank is made from paperboard material.

10. An innerframe for insertion into a cigarette box, the cigarette box having a bottom box panel, a top lid box panel, opposing right and left side box panels, an innerframe for securely retaining a bundle of cigarettes within the box, the innerframe comprising:

a front panel defined by a pair of parallel first and second fold lines and top and bottom panel margins;

a first outer side panel which is substantially rectangular in shape, the first outer side panel connected to the front panel along the first fold line, and further defined by a first top panel fold line;

a second outer side panel which is substantially rectangular in shape, the second outer side panel connected to the front panel along the second fold line, and further defined by a third top panel fold line;

a first top panel connected to the first outer side panel along the first top fold line and further defined by a second top panel fold line;

a second top panel connected to the second outer side panel along the third top panel fold line and further defined by a fourth top panel fold line;

a first window defined by a first, a second and a third window panel score line, a first upper horizontal window panel cut and a first lower horizontal window panel cut and located between the front panel and the first outer side panel, the first window further comprising a first side window panel connected to the front panel along the first window panel score line and further defined by the second window panel score line, a first rear window panel connected to the first outer side panel along the third window panel score line and connected to the first side window panel along the second window panel score line;

a second window defined by a fourth, a fifth and a sixth window panel score line, a second upper horizontal window panel cut and a second lower horizontal window panel cut and located between the front panel and the second outer side panel, the second window further comprising a second side window panel connected to the front panel along the fourth window panel score line and further defined by the fifth window panel score line, a second rear window panel connected to the second outer side panel along the sixth window panel score line and connected to the second side window panel along the fifth window panel score line;

a first inner side panel connected to the first top panel along the second top panel fold line;

a second inner side panel connected to the second top panel along the fourth top panel fold line wherein the innerframe is erected and inserted into cigarette box so that the front panel is contiguous with the front box panel, the first outer side panel is contiguous with the right side box panel, the second outer side panel is contiguous with the left side box panel, and the first and second top panels extend between the front and back box panels.

11. The innerframe of claim 10 wherein the innerframe is adhesively attached to the cigarette box.

12. The innerframe of claim 11 wherein the innerframe is made from paperboard.

13. The innerframe of claim 10 wherein the first top panel is provided with a first locking tab engageable with the first side window panel and the second top panel is provided with a second locking tab engageable with the second side window panel.

14. The innerframe of claim 10 wherein the first, the second, the third, the fourth, the fifth, and the sixth window panel score lines are perforated.

15. The innerframe of claim 10 wherein the front panel is provided with a first lid retention cut located along the first fold line and above the first window, and a second lid retention cut located along the second fold line and above the second window.

16. The innerframe of claim 10 wherein the first and the second lid retention cuts are substantially C-shaped.

17. The innerframe of claim 10 wherein the first outer side panel is provided with a first lid retention ear extending angularly between an outside margin of the first outer side panel and the first top panel fold line and a second lid retention ear extending angularly between an outside margin of the second outer side panel and the third top panel fold line.

18. A cigarette box, the cigarette box comprising:

a bottom box panel;

a top lid box panel;

an innerframe for insertion into the cigarette box for securely retaining a bundle of cigarettes within the cigarette box, the innerframe further comprising:

a front panel defined by a pair of parallel first and second fold lines and top and bottom panel margins;

a first outer side panel which is substantially rectangular in shape, the first outer side panel connected to the front panel along the first fold line, and further defined by a first top panel fold line;

a second outer side panel which is substantially rectangular in shape, the second outer side panel connected to the front panel along the second fold line, and further defined by a third top panel fold line;

a first top panel connected to the first outer side panel along the first top fold line and further defined by a second top panel fold line;

a second top panel connected to the second outer side panel along the third top panel fold line and further defined by be a fourth top panel fold line;

a first window defined by a first, a second and a third window panel score line, a first upper horizontal window panel cut and a first lower horizontal window panel cut and located between the front panel and the first outer side panel, the first window further comprising a first side window panel connected to the front panel along the first window panel score line and further defined by the second window panel score line, a first rear window panel connected to the first outer side panel along the third window panel score line and connected to the first side window panel along the second window panel score line;

a second window defined by a fourth, a fifth and a sixth window panel score line, a second upper horizontal window panel cut and a second lower horizontal window panel cut and located between the front panel and the second outer side panel, the second window further comprising a second side window panel connected to the front panel along the fourth window panel score line and further defined by the fifth window panel score line, a second rear window panel connected to the second outer side panel along the sixth window panel score line and connected to the second side window panel along the fifth window panel score line;

a first inner side panel connected to the first top panel along the second top panel fold line;

a second inner side panel connected to the second top panel along the fourth top panel fold line wherein the innerframe is erected and inserted into cigarette box so that the front panel is contiguous with the front box panel, the first outer side panel is contiguous with the right side box panel, the second outer side panel is contiguous with the left side box panel, and the first and second top panels extend between the front and back box panels.

19. The innerframe of claim 18 wherein the first top panel is provided with a first locking tab engageable with the first side window panel and the second top panel is provided with a second locking tab engageable with the second side window panel.

20. The innerframe of claim 18 wherein the first, the second, the third, the fourth, the fifth, and the sixth window panel score lines are perforated.

21. The innerframe of claim 18 wherein the front panel is provided with a first lid retention cut located along the first fold line and above the first window, and a second lid retention cut located along the second fold line and above the second window.

22. The innerframe of claim 20 wherein the first and the second lid retention cuts are substantially C-shaped.

23. The innerframe of claim 18 wherein the first outer side panel is provided with a first lid retention ear extending angularly between an outside margin of the first outer side panel and the first top panel fold line and a second lid retention ear extending angularly between an outside margin of the second outer side panel and the third top panel fold line.

24. The innerframe of claim 18 wherein the first and second fold lines are folded to erect the first outer side panel and the second side panel perpendicular to the front panel, the first top and second top panel fold lines are folded to erect the first top panel and the first inner side panel, the first top panel being perpendicular to both the front panel and the first outer side panel and the first inner side panel parallel to the first outer side panel, the third and fourth top panel fold lines are folded to erect the second top panel and the second inner side panel, the first top panel being perpendicular to both the front panel and the second outer side panel and the second inner side panel being parallel to the second outer side panel.

25. The innerframe of claim 18 wherein the front panel is further defined by a cutout region at the top margin thereby forming an opening through which cigarettes may be withdrawn.

26. The innerframe of claim 18 wherein the innerframe is made from paperboard material.

* * * * *